US008240295B2

(12) United States Patent
Yang

(10) Patent No.: US 8,240,295 B2
(45) Date of Patent: Aug. 14, 2012

(54) PARTICULATE FILTER SYSTEM FOR VEHICLE AND METHOD OF CONTROLLING THE SAME

(75) Inventor: Tae Joung Yang, Hwaseong-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 202 days.

(21) Appl. No.: 12/612,509

(22) Filed: Nov. 4, 2009

(65) Prior Publication Data

US 2010/0139630 A1 Jun. 10, 2010

(30) Foreign Application Priority Data

Dec. 5, 2008 (KR) ..... 10-2008-0122880

(51) Int. Cl.
*F02B 47/08* (2006.01)

(52) U.S. Cl. ..... 123/568.19; 123/568.21; 123/556

(58) Field of Classification Search ..... 123/568.11, 123/568.17–568.19, 568.21, 198 E, 556; 60/287, 293, 304, 308
See application file for complete search history.

(56) References Cited

U.S. PATENT DOCUMENTS

| | | | | | |
|---|---|---|---|---|---|
| 4,122,679 | A * | 10/1978 | Charron | 60/599 |
| 4,534,173 | A * | 8/1985 | Tsukamoto | 60/606 |
| 4,833,886 | A * | 5/1989 | Meier | 60/602 |
| 5,724,813 | A * | 3/1998 | Fenelon et al. | 60/606 |
| 6,276,139 | B1 * | 8/2001 | Moraal et al. | 60/605.2 |
| 6,295,816 | B1 * | 10/2001 | Gallagher et al. | 60/611 |
| 6,324,846 | B1 * | 12/2001 | Clarke | 60/605.2 |
| 7,533,657 | B2 * | 5/2009 | Onodera | 123/568.11 |
| 7,644,584 | B2 * | 1/2010 | Leustek et al. | 60/611 |
| 7,913,488 | B2 * | 3/2011 | Schick et al. | 60/289 |
| 2005/0011184 | A1 * | 1/2005 | Price et al. | 60/286 |
| 2011/0072791 | A1 * | 3/2011 | Bidner et al. | 60/278 |
| 2011/0072793 | A1 * | 3/2011 | Bidner et al. | 60/285 |
| 2011/0072799 | A1 * | 3/2011 | Bidner et al. | 60/286 |
| 2011/0072800 | A1 * | 3/2011 | Bidner et al. | 60/286 |
| 2011/0072802 | A1 * | 3/2011 | Bidner et al. | 60/287 |
| 2011/0146274 | A1 * | 6/2011 | Shimizu et al. | 60/611 |

FOREIGN PATENT DOCUMENTS

| | | | |
|---|---|---|---|
| JP | 2003-184542 | A | 7/2003 |
| JP | 2003-206723 | A | 7/2003 |
| JP | 2005-36726 | A | 2/2005 |
| JP | 2005-282545 | A | 10/2005 |
| JP | 2006-233803 | * | 9/2006 |

* cited by examiner

*Primary Examiner* — Hai Huynh
(74) *Attorney, Agent, or Firm* — Morgan, Lewis & Bockius LLP

(57) ABSTRACT

A particulate filter (PF) system for a vehicle is equipped with a bypass air line branching off from a throttle body so as to be able to smoothly regenerate a PF regardless of operation of an engine. The PF system includes an exhaust manifold into which exhaust gas flows from an engine, a bypass line connected to the exhaust manifold, an exhaust gas recirculation valve installed on the bypass line, and blocking or passing a flow of air of the bypass line, and a particulate filter installed on the exhaust manifold to collect and remove particulate matter.

6 Claims, 2 Drawing Sheets

PARTICULATE FILTER SYSTEM FOR VEHICLE AND METHOD OF CONTROLLING THE SAME

CROSS-REFERENCE TO RELATED APPLICATION

The present application claims priority to Korean Patent Application No. 10-2008-0122880 filed on Dec. 5, 2008, the entire contents of which is incorporated herein for all purposes by this reference.

BACKGROUND OF THE INVENTION

1. Field of the Invention

The present invention generally relates to a particulate filter system for a vehicle and a method of controlling the same, and more particularly, to a particulate filter system for a vehicle, which is equipped with a bypass air line branching off from a throttle body so as to be able to smoothly regenerate a particulate filter regardless of operation of an engine, and a method of controlling the same.

2. Description of Related Art

In general, a vehicle using an engine (hereinafter, referred to as a vehicle) inevitably exhausts particulate matter such as soot. The exhaust gas of the vehicle contains a large quantity of particulate matter composed of carbon, unburned hydrocarbon, etc. due to incomplete combustion of fuel. This particulate matter is known to cause a human being a disease such as lung cancer. As such, various plans for regulating emissions of the particulate matter and reducing the particulate matter have been developed throughout the world. As one of technologies that remove this particulate matter, post-treatment technology of the particulate matter is primarily used.

As the post-treatment technology that is most widely used at present, a particulate filter (PF) having a porous filter is mounted on an exhaust manifold of the vehicle so as to collect exhausted particulate matter.

The PF collects the particulate matter exhausted from the engine through the use of a filter, and then burns off the collected particulate matter. Thereby, the filter is regenerated for repetitive use. Thus, this filter regeneration must be completed so as to enable the filter to collect the particulate matter again by burning off the particulate matter collected by the PF as soon as possible. At this time, a control technique for preventing the filter from being overheated and damaged by the regeneration is important. This type of filter regeneration is essentially supplied with oxygen because it burns off the collected particulate matter.

Meanwhile, in order to serve environmental protection not only by improving fuel efficiency but also by reducing the exhaust gas, a so-called idle stop and go (ISG) function has recently been used for allowing the engine to stop operating when a vehicle is stopped for instance while waiting for the green light and to be immediately operated again when the vehicle starts.

However, the oxygen required for the filter regeneration is supplied by oxygen existing in the exhaust manifold. As such, in the state in which the engine stops operating, the oxygen is not naturally supplied from the exhaust manifold. Although such an ISG function is activated to cause the engine to be stopped, it is necessary to carry out the filter regeneration. To this end, an air passage connected between the exhaust manifold and the outside is separately formed, and an oxygen supply means including, for instance a blower, an air control valve, etc., is provided so as to allow air to be introduced through the air passage. Thereby, the oxygen for the filter regeneration is supplied.

This PF of the vehicle is separately equipped with the air passage connected to the exhaust manifold and the outside, the blower and air control valve for controlling flow of the air, etc., so that the vehicle suffers from a complicated structure and an increase in the cost of production.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a particulate filter (PF) system for a vehicle and a method of controlling the same, in which oxygen required to regenerate a PF is supplied using a conventional engine system without an additional oxygen supplying means when an idle stop and go (ISG) function is activated to stop operation of an engine, thereby simplifying a structure of the vehicle and reducing the cost of production.

In an aspect of the present invention, the particulate filter system for a vehicle may include an exhaust manifold into which exhaust gas flows from a engine, means for selectively supplying oxygen to the exhaust manifold by bypassing the engine, and a particulate filter installed on the exhaust manifold, wherein the particulate filter collects particulate matter and removes the collected particulate matter therein.

The oxygen supplying means may include a bypass line connected to the exhaust manifold, and an exhaust gas recirculation valve installed on the bypass line, and blocking or passing a flow of air of the bypass line.

The bypass line may extend from a throttle body connected to the engine and the bypass line.

In another aspect of the present invention, the particulate filter system may further include an air heater heating the air flowing into the throttle body.

In further another aspect of the present invention, the particulate filter system may further include a temperature sensor measuring an internal temperature of the particulate filter.

In still another aspect of the present invention, a method of controlling regeneration of a particulate filter system for a vehicle may include supplying oxygen to an exhaust manifold through a bypass line bypassing an engine when the engine stops operating during regeneration of a particulate filter installed on an exhaust manifold.

The supplying of oxygen may includes determining whether or not the engine is operated, regenerating the particulate filter when the engine is operated, but, when the engine is not operated, measuring an internal temperature of the particulate filter and comparing the measured temperature with a reference temperature, and stopping the regeneration of the particulate filter when the measured temperature of the particulate filter exceeds the reference temperature, but, when the measured temperature of the particulate filter does not exceed the reference temperature, opening a throttle valve and an exhaust gas recirculation valve to regenerate the particulate filter, wherein the throttle valve is connected to the bypass line and the engine and the exhaust gas recirculation valve is installed on the bypass line.

The method may further include operating an air heater prior to opening the throttle valve and the exhaust gas recirculation valve, wherein the air heater is configured to supply air to the throttle body.

According to various aspects of the present invention, the PF system can supply oxygen required for regeneration of the PF using a conventional engine system without an additional oxygen supplying means such as an external air passage, so that the vehicle can simplify its structure and reduce the cost of production.

Further, the PF can be prevented from being damaged or broken by overheat occurring in the process of regenerating the PF, so that its durability can improved.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
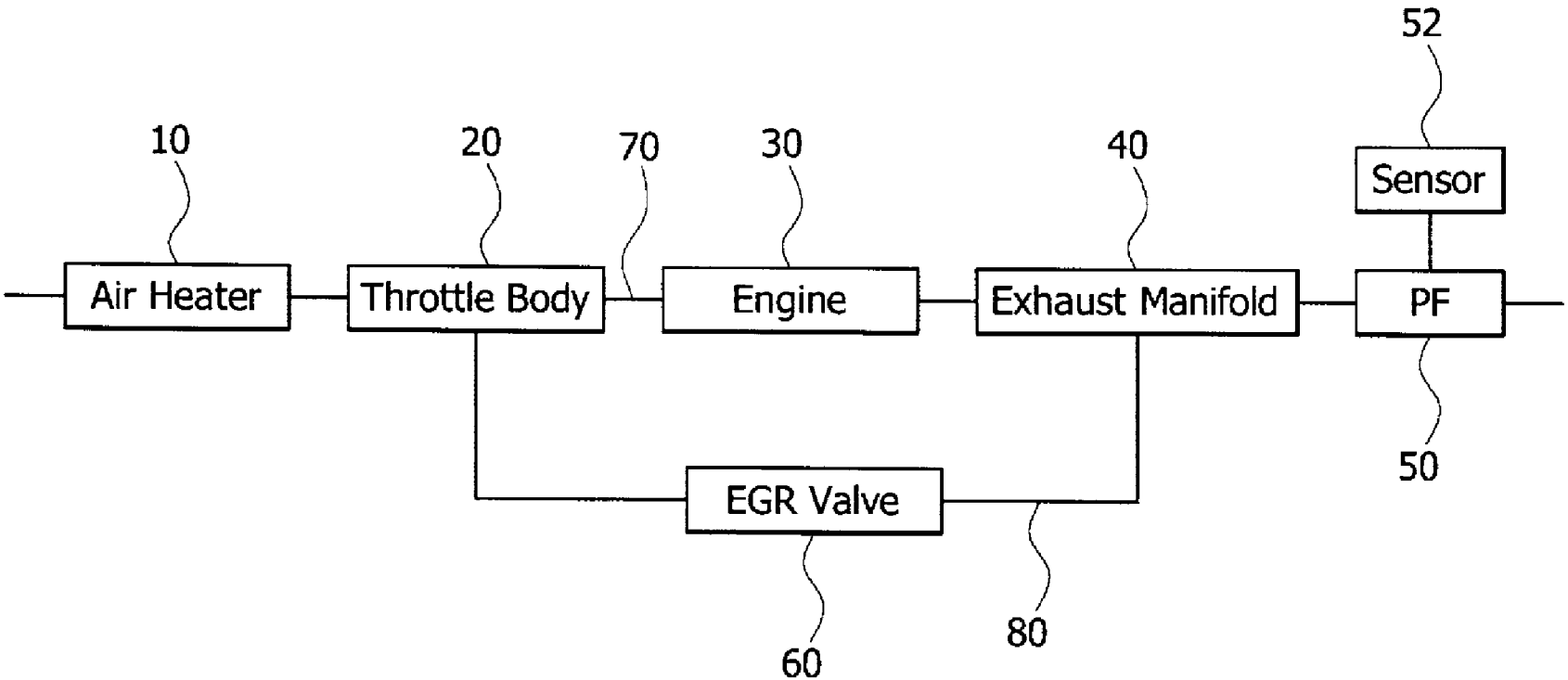
FIG. 1 illustrates a schematic layout of a particulate filter system for a vehicle according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

FIG. 1 illustrates a schematic layout of a particulate filter (PF) system for a vehicle according to an embodiment of the present invention. The PF system is installed on an exhaust manifold 40, and burns off particulate matter collected by a PF 50, thereby regenerating the PF 50.

The PF system generally includes an exhaust manifold 40 into which exhaust gas of a fuel burned by an engine 30 flows, a PF 50 installed on the exhaust manifold 40 to collect particulate matter and burn off and remove the collected particulate matter, means for selectively supplying a predetermined amount of oxygen required for burning-based regeneration of the PF 50 to the exhaust manifold 40 by bypassing the engine 30, a throttle body 20 controlling the amount of air flowing into the oxygen supplying means, and an air heater 10 heating the air flowing into the throttle body 20. The air heater 10, throttle body 20, engine 30, exhaust manifold 40 and PF 50 are installed on the same exhaust line 70, while the oxygen supplying means branches off from the throttle body 20 on the exhaust line 70, bypasses the engine 30, and is connected to the exhaust manifold 40.

In this embodiment, the oxygen supplying means includes a bypass line 80 extending from the throttle body 20 and connected to the exhaust manifold 40, and an exhaust gas recirculation (EGR) valve 60 installed on the bypass line 80 and blocking or passing a flow of air of the bypass line 80.

Both the EGR valve 60 and the bypass line 80 are known parts used to reduce nitrogen oxides in the exhaust gas exhausted from the engine 30. A part of the exhaust gas exhausted from the engine 30 to the exhaust manifold 40 flows again into a combustion chamber of the engine 30 through the bypass line 80 by regulation of the EGR valve 60.

In detail, the bypass line 80, which is connected between the throttle body 20 connected to an intake manifold and the exhaust manifold 40, serves as a channel of the exhaust gas flowing again into the engine 30 as described above. The EGR valve 60 regulates a flow of the exhaust gas of the bypass line 80, thereby adjusting the amount of the exhaust gas flowing into the engine 30.

As described above, the bypass line 80 and the EGR valve 60, both of which are used to cause the exhaust gas to flow again into the engine 30, are configured to serve to supply the oxygen required for the regeneration of the PF when an Idle Stop and Go (ISG) function of the vehicle is activated. At this time, the EGR valve 60 is closed at normal times, and is opened by an operation signal received from an Electronic Control Unit (ECU).

Thus, when the engine 30 is operated, and when the EGR valve 60 blocking the air from flowing through the bypass line 80 is opened by the signal of the ECU, a part of the exhaust gas flows again into the engine 30 through the bypass line 80. During the operation of the engine 30, the air does not supplied to the exhaust manifold 40 through the bypass line 80.

Then, when the engine 30 stops operating by means of the activation of the ISG function, and when the PF system is operated, the EGR valve 60 is opened in order to supply the oxygen required for the regeneration. Thereby, the oxygen bypasses the engine 30 through the bypass line 80, and is supplied to the exhaust manifold 40.

Meanwhile, in order to smoothly regenerate the PF, the PF 50 must maintain an internal temperature higher than a predetermined temperature. To this end, the air heater 10 is located in front of the throttle body 20. The air flowing into the throttle body 20 is heated by the air heater 10, so that it can be supplied at temperature suitable for the regeneration of the PF 50.

In this manner, for smooth regeneration of the PF 50, the PF 50 must maintain the internal temperature higher than the predetermined temperature. However, if the internal temperature of the PF 50 is excessively raised, the PF 50 is damaged by heat. In the worst case, the PF 50 is broken. Thus, as a result of measuring the internal temperature of the PF 50, when the internal temperature of the PF 50 exceeds a specific temperature, it is necessary to block the air supplied to the PF 50 to stop the regeneration of the PF 50. To this end, the PF 50 is equipped with a temperature sensor 52 on one side thereof. The temperature sensor 52 measures the internal temperature of the PF 50, and sends the measured temperature to the ECU. Then, on the basis of the measured temperature of the PF 50 received from the temperature sensor 52, the ECU determines whether or not to regenerate the PF.

The regeneration of the PF makes use of a so-called burning-based filter regeneration technique that burns off the particulate matter collected by the PF 50. This regeneration of the PF is carried out in the same fashion as in an ordinary vehicle. For example, a pressure difference between front and rear ends of the PF 50 is detected while the particulate matter is collected through the PF 50 installed on the exhaust manifold 40. It is checked through the pressure difference how much the particulate matter is collected by the PF 50. In other words, an amount of the collected particulate matter is detected. In the case in which the ECU determines that it is necessary to perform the regeneration (burning) on the basis of the detected result, the particulate matter of the PF 50 is forcibly burned off such that the PF 50 continues to be regenerated. At this time, a heat source required for the burning employs an external heat source such as a Oxidation Catalyst (OC), an electric heater, a burner, a post injection or the like which is located in front of the PF 50. Further, the oxygen required for the burning can be sufficiently supplied from oxygen remaining in the exhaust gas in the light of the characteristic of the engine 30 based on lean burn. The regeneration of the PF has already been known, and so its detailed description will be omitted.

Now, the operation of the PF system having the aforementioned configuration will be described in detail.

Figure 2:
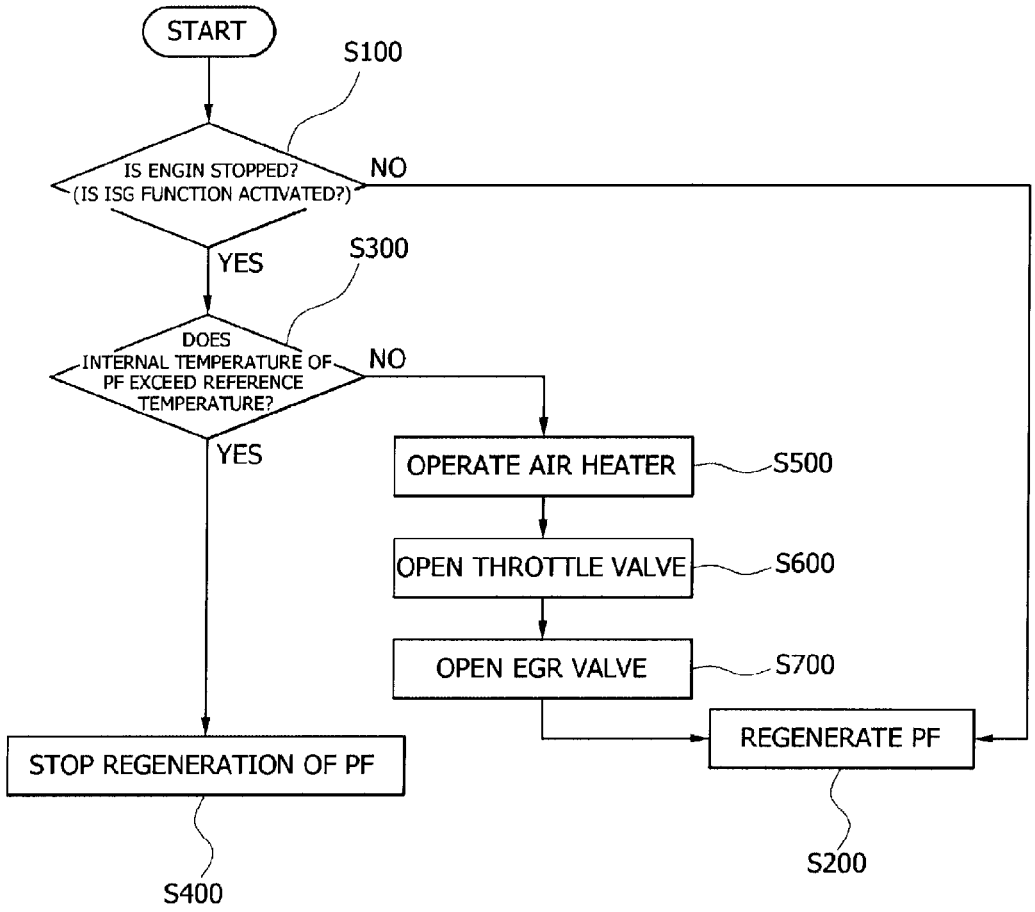
FIG. 2 is a control flowchart illustrating a method of controlling regeneration of a PF system for a vehicle in accordance with an exemplary embodiment of the present invention.

FIG. 2 is a control flowchart illustrating a method of controlling regeneration of a PF system for a vehicle in accordance with an embodiment of the present invention.

First, in step S100, it is determined whether or not the engine 30 is operating in order to regenerate the PF.

When it is determined that the engine 30 is operating i.e. when the ISG function is not activated in step S100, the PF is regenerated in the same fashion as in the prior art (S200). At this time, the EGR valve 60 is closed. As a result, the air does not flow through the bypass valve 80, but only the exhaust line 70. The air flowing into the engine 30 through the throttle body 20 is burned off in the engine 30 together with the fuel, and then is exhausted to the exhaust manifold 40. The PF 50 installed on the exhaust manifold 40 is regenerated using the exhaust gas exhausted to the exhaust manifold 40.

Meanwhile, in step S100 of determining whether or not the engine 30 is operated, when it is determined that the engine 30 stops operating, i.e. when the ISG function is activated, the internal temperature of the PF 50 is measured by the temperature sensor 52, and then the measured temperature is compared with a preset reference temperature (S300).

In step S300 of comparing the measured temperature of the PF 50 with the reference temperature, when the measured temperature of the PF 50 exceeds the reference temperature, the PF system is not operated.

hi step S300 of comparing the measured temperature of the PF 50 with the reference temperature, when the measured temperature of the PF 50 does not exceed the reference temperature, the PF system is operated using the EGR valve 60 and the bypass line 80 (S500, S600, S700 and S800). At this time, since the engine 30 stops operating, neither exhaust gas nor oxygen is supplied to the exhaust manifold 40 through the exhaust line 70. Thus, in order to supply the oxygen required for the operation of the PF system, the EGR valve 60 is opened to supply the oxygen to the exhaust manifold 40 through the bypass line 80.

In this case, in order to supply the oxygen at a temperature suitable for the operation of the PF system, the air heater 10 is operated (S500). Then, a throttle valve in the throttle body 20 is opened (S600), and then the EGR valve 60 is opened (S700). The air heated by the air heater 10 is supplied to the exhaust manifold 40 through the bypass line 80 so as to be used for the operation of the PF system.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the claims appended hereto and their equivalents.

What is claimed is:

1. A particulate filter system for a vehicle comprising:

an exhaust manifold into which exhaust gas flows from an engine;

means for supplying oxygen to the exhaust manifold by bypassing the engine when the engine stops operating during regeneration of a particulate filter; and the particulate filter installed on the exhaust manifold, wherein the particulate filter collects particulate matter and removes the collected particulate matter therein, wherein the oxygen supplying means includes:

a bypass line connecting a throttle body and the exhaust manifold of the engine; and an exhaust gas recirculation valve installed on the bypass line, and blocking or passing a flow of air of the bypass line.

2. The particulate filter system according to claim 1, further comprising an air heater heating the air flowing into the throttle body.

3. The particulate filter system according to claim 1, further comprising a temperature sensor measuring an internal temperature of the particulate filter.

4. A method of controlling regeneration of a particulate filter system for a vehicle, the method comprising:

supplying oxygen to an exhaust manifold through a bypass line bypassing an engine when the engine stops operating during regeneration of a particulate filter installed on an exhaust manifold, wherein the bypass line connects a throttle valve and the exhaust manifold and an exhaust gas recirculation valve is installed on the bypass line.

5. The method according to claim 4, wherein the supplying of oxygen includes:

determining whether or not the engine is operated;

regenerating the particulate filter when the engine is operated, but, when the engine is not operated, measuring an internal temperature of the particulate filter and comparing the measured temperature with a reference temperature; and stopping the regeneration of the particulate filter when the measured temperature of the particulate filter exceeds the reference temperature, but, when the measured temperature of the particulate filter does not exceed the reference temperature, opening the throttle valve and the exhaust gas recirculation valve to regenerate the particulate filter.

6. The method according to claim 5, further comprising operating an air heater prior to opening the throttle valve and the exhaust gas recirculation valve, wherein the air heater is configured to supply air to the throttle body.

* * * * *